US005548563A

United States Patent [19]

Slevinsky

[11] Patent Number: 5,548,563

[45] Date of Patent: Aug. 20, 1996

[54] WELL TEST IMAGING

[75] Inventor: Bruce A. Slevinsky, Calgary, Canada

[73] Assignee: Petro-Canada, Calgary, Canada

[21] Appl. No.: 124,054

[22] Filed: Sep. 17, 1993

[51] Int. Cl.[6] ..... G01V 1/40; E21B 49/00

[52] U.S. Cl. ..... 367/25; 364/422; 175/50; 166/250.01

[58] Field of Search ..... 367/25; 364/422; 175/48, 50; 166/113, 250

[56] References Cited

U.S. PATENT DOCUMENTS

| | | | |
|---|---|---|---|
| 4,607,524 | 8/1986 | Gringarten | 73/152 |
| 4,799,157 | 1/1989 | Kueuk et al. | 364/422 |
| 5,431,227 | 7/1995 | Montgomery et al. | 66/307 |

FOREIGN PATENT DOCUMENTS 2281971 3/1995 United Kingdom .

OTHER PUBLICATIONS

Advances in Well Test Analysis, Robert C. Earlougher, Jr., Society of Petroleum Engineers of AIME, New York 1977 Dallas, Chapter 2, pp. 4–8 and 18–20; Chapter 3, pp. 22–23; Chapter 6, pp. 45–49; Appendix E, pp. 242–245.

Larsen, L. , Norwegian Inst. Technol. et al N Sea Oil & Gas Reservoirs Seminar, Dec. 2, 1985, pp. 257–268. Abst. only.

Ehlig–Economides, C., J. Pefr. Technol., vol. 40, #10, pp. 1280–1282, Oct. 1988; abst. only herewith.

Larsen, L., 58th Anmu. SPB of AIMB Tech Conf. Oct. 5, 1983, SPE–12135, 15 PP; abst. only herewith.

*Primary Examiner*—Nelson Moskowitz

*Attorney, Agent, or Firm*—Millen, White, Zelane, & Branigan, P.C.

[57] ABSTRACT

A method is provided for establishing the location and orientation of the boundaries surrounding a subterranean reservoir and creating an image thereof. A conventional pressure test is performed on a well, establishing measures of the well's pressure response as defined by the rate of pressure change in the reservoir over time. Conventional techniques are used to determine measures of the radius of investigation. A calculated response for an infinite and radially extending well and the measured response are compared as a ratio. Variation of the ratio from unity is indicative of the presence of a boundary and its magnitude is related to an angle-of-view. The angle-of-view is related to the orientation of the boundary to the well. By combining the angle-of-view and the radius of investigation, one can define vectors which extend from the well to locations on the boundary, thereby defining an image of the boundary. In an alternate embodiment, the angle-of-view and radius of investigation can be applied in a converse manner to predict the pressure response of a well from a known set of boundaries.

6 Claims, 11 Drawing Sheets

WELL TEST IMAGING

FIELD OF THE INVENTION

The present invention relates to a method for determining the location and orientation of subterranean reservoir boundaries from conventional well pressure test data. In another aspect, a method is provided for predicting well test pressure response from known boundaries.

BACKGROUND OF THE INVENTION

To determine the characteristics of a bounded reservoir in a subterranean formation, well pressure tests are performed. Such a well test may comprise opening the well to drawdown the reservoir pressure and then closing it in to obtain a pressure buildup. From this pressure versus time plots may be determined. A plot of the well pressure against the (producing time+shut-in time) divided by the shut-in time is typically referred to as the Homer Curve. An extension of this presentation is the Bourdet Type Curve which plots a derivative of the Homer Curve.

The response of the Bourdet Type Curve may be summarized as representing three general behavioral effects: the near-wellbore effects; the reservoir matrix parameter effects; and the reservoir boundary effects.

Lacking direct methods of calculating boundary effects, conventional well test analysis involves matching a partial differential equation to the well test data, as follows:

$$\frac{\partial^2 p}{\partial r^2}+\frac{1}{r}\frac{\partial p}{\partial r}+\frac{k_\theta}{k_r}\frac{1}{r^2}\frac{\partial^2 p}{\partial \theta^2}+\frac{k_z}{k_r}\frac{\partial^2 p}{\partial z^2}=\frac{\phi\partial\mu c_t}{k_r}\frac{\partial p}{\partial t}$$

This differential equation includes all the reservoir matrix parameters including pressure (p), permeability (k), porosity ($\phi$), viscosity ($\mu$), system compressibility (c), angle $\theta$ and time (t). Needless to say, the solution is complex and requires that simplifying assumptions of the boundaries be made.

The easiest boundary assumption to make is that the reservoir is infinitely and radially extending, no boundary in fact existing. This is represented on a Bourdet Type curve by a late time behavior approach of the pressure derivative curve to a constant slope. Should any upward deviation occur in this late time behaviour portion of the curve, then a finite boundary is indicated.

When a boundary is indicated, then simplifying geometry assumptions of the boundary are introduced into the solution to facilitate calculation of its location. Prior art numerical modelling to date has usually used a series of linearly extending boundaries. One to four linear boundaries are used, all acting in a rectangular orientation to one another at varying distances from the well. When a theoretically modelled response finally resembles the actual field response, the model is assumed to be representative. This provides only one of many possible matched solutions which may or may not represent the geological boundaries.

Rarely are native geological boundaries such as faults and formation shifts oriented exclusively in 90 degree, rectangular fashion. Often, a geologic discontinuity or fault may intersect another in a manner which would result in an indeterminate boundary as determined with the conventional analysis techniques. One such discontinuity might be categorized as a "leak" at an unknown distance or orientation.

Great dependence is placed upon conventional seismic data to assist in orienting the assumed linear boundaries. Seismic data itself is often times subject to low resolution and may not reveal sub-seismic faults which can significantly affect the reservoir boundaries and response.

Considering the above, an improved method of determining the boundaries of a reservoir layer is provided, avoiding the theoretically difficult and crudely modelled approximations available currently in the art, resulting in a more accurate image of the reservoir boundaries.

SUMMARY OF THE INVENTION

In accordance with the invention, an improved well test imaging method is provided for relating transient pressure response data of a well test to its reservoir boundaries.

More particularly, well test imaging or well test image analysis is a well test interpretation method which allows direct calculation of an image (or picture) of the boundaries, their relationship to each other, and location in the region of reservoir sampled by a conventional well pressure test. The method and theory on which it is based enable the rapid calculation of Bourdet derivative-type curves for complex reservoir boundary situations without requiring the use of complex LaPlace space solutions or numerical inversions. Suitable application of the method to multi-layered reservoir situations allows the development of correlated 3-dimensional models of the region surrounding a well which can be mechanically fabricated or realized in computer form to permit 3-dimensional visualization of the reservoir geometry.

In a first aspect, one avoids the over-simplification of boundary geometry and the highly complex theoretical treatment of the prior art, to directly and more accurately determine the location and orientation of reservoir boundaries. One determines the rate of pressure change over time using conventional well pressure test, more particularly a drawdown, build-up, fall off or pulse test. Then one extracts the near-wellbore and matrix effects, representative of the response for a conventional infinitely and radially extending reservoir, from the measured pressure response by dividing one response by the other. Thus, a response ratio is mathematically determined, the magnitude of which, as it deviates from unity, is related to an angle-of-view which defines the orientation of a detected boundary.

The angle-of-view is also geometrically equivalent to the included angle between vectors drawn between the well and intersections of a plurality of analogous pressure wavefronts, representing the pressure response, and the boundary. By relating the length of each vector, extending a distance from the well as determined by a radius of investigation, and their orientation as defined by each angle-of-view, one can establish the location of a plurality of coordinates thereby defining an image of the boundary.

In a preferred aspect, images determined for multiple layers of a reservoir can be combined to form a three-dimensional reservoir boundary image.

In one broad aspect then, the invention is a method for creating an image of a reservoir boundary from well pressure test data values comprising:

- obtaining reservoir pressure response values from a well pressure test selected from the group consisting of drawdown, build-up, fall off and pulse tests;
- using the pressure response values obtained to calculate data values reflecting the rate of pressure change over time and the radius of investigation;
- extracting from the derivative values the response that is due to near-wellbore and matrix effects to obtain residual values representative of boundary effects;

calculating values from the residual values representative of an angle-of-view of the boundary as a function of time; and calculating values, from the angle-of-view and the radius of investigation values, representative of the coordinates of the boundaries of the reservoir and forming visual images of the reservoir boundaries relative to the location of the well using said values.

In another aspect, the geometric relationship of boundaries, the radius of investigation and the angle-of-view are used in a converse manner to predict the pressure response at a well for an arbitrary set of boundaries. One calculates the radius of investigation for multiple time increments and measures corresponding angles-of-view to the known boundaries. One then goes on to calculate the response ratio from the angle-of-view for each time increment; then calculates a pressure response for the infinite reservoir case; and then predicts the actual well response by multiplying the infinite response and the ratio together.

In another broad aspect then, the invention is a method for predicting the pressure response at a well in a reservoir assumed to be of constant thickness from reservoir boundaries whose position relative to the location of the well is known, comprising:

calculating values representative of angle-of-view and radius of investigation of the boundaries as a function of time;

calculating response ratios representative of boundary effects from the geometric values; and combining with the response ratios the response that is due to near-wellbore and matrix effects to obtain pressure response values reflecting the predicted rate of pressure change over time for the well.

BRIEF DESCRIPTION OF THE DRAWINGS

FIG. 14 is a BASIC computer program, RBOUND.BAS in support of Example II, and has a sample data file, SAMPLE.BND appended thereto. It is an appendix to the specification, and is not included with the drawing Figures.

DETAILED DESCRIPTION OF THE PREFERRED EMBODIMENT

Figure 1:
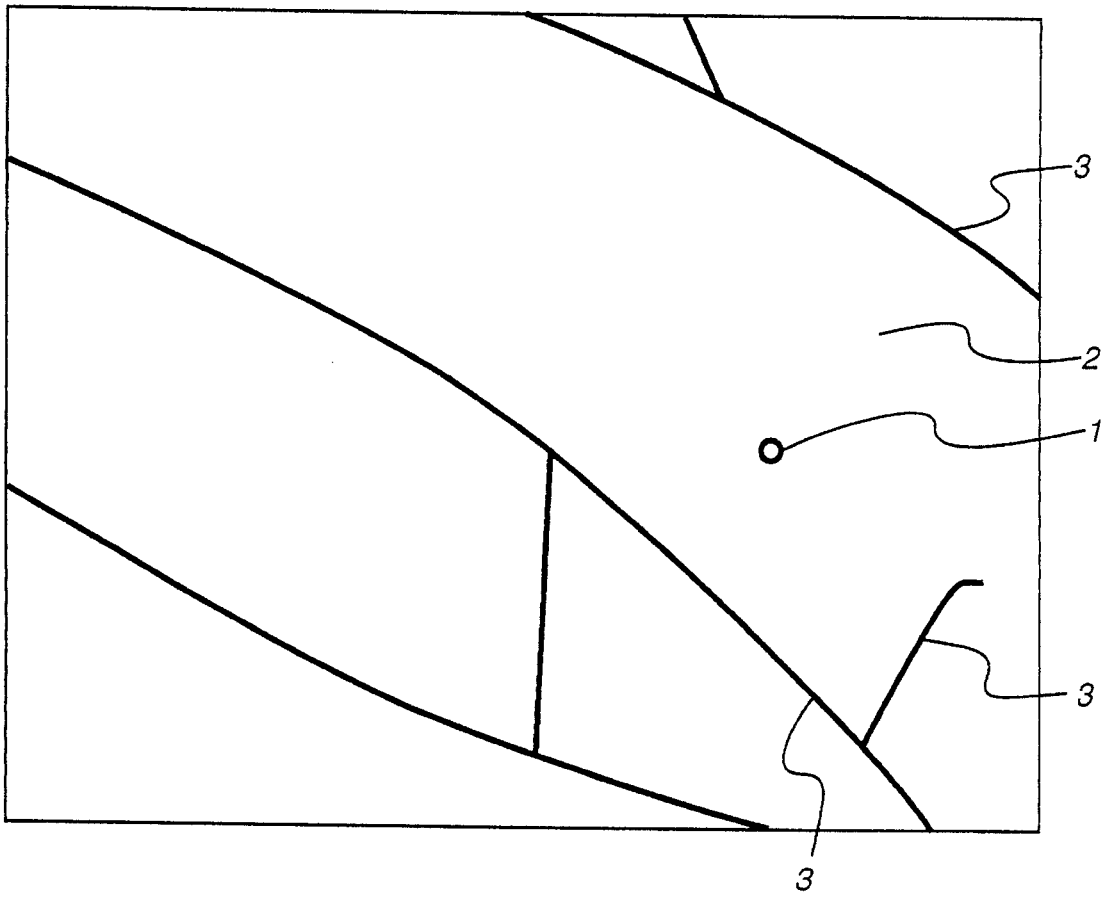
FIG. 1 is an aerial view or image of known seismic boundaries for a well and reservoir.

Referring to FIG. 1, a well 1 is completed into one of multiple layers of a formation which is part of an oil, gas, or water-bearing reservoir 2. The reservoir 2 is typically bounded by geological discontinuities or boundaries 3 such as faults. These boundaries 3 alter the behavior of the reservoir 2.

A conventional pressure well test is performed to collect pressure response data from the reservoir 2. Typically the well 1 is produced, resulting in a characteristic pressure draw-down curve. The well 1 is then shut-in permitting the pressure to build-up again.

Figure 2:
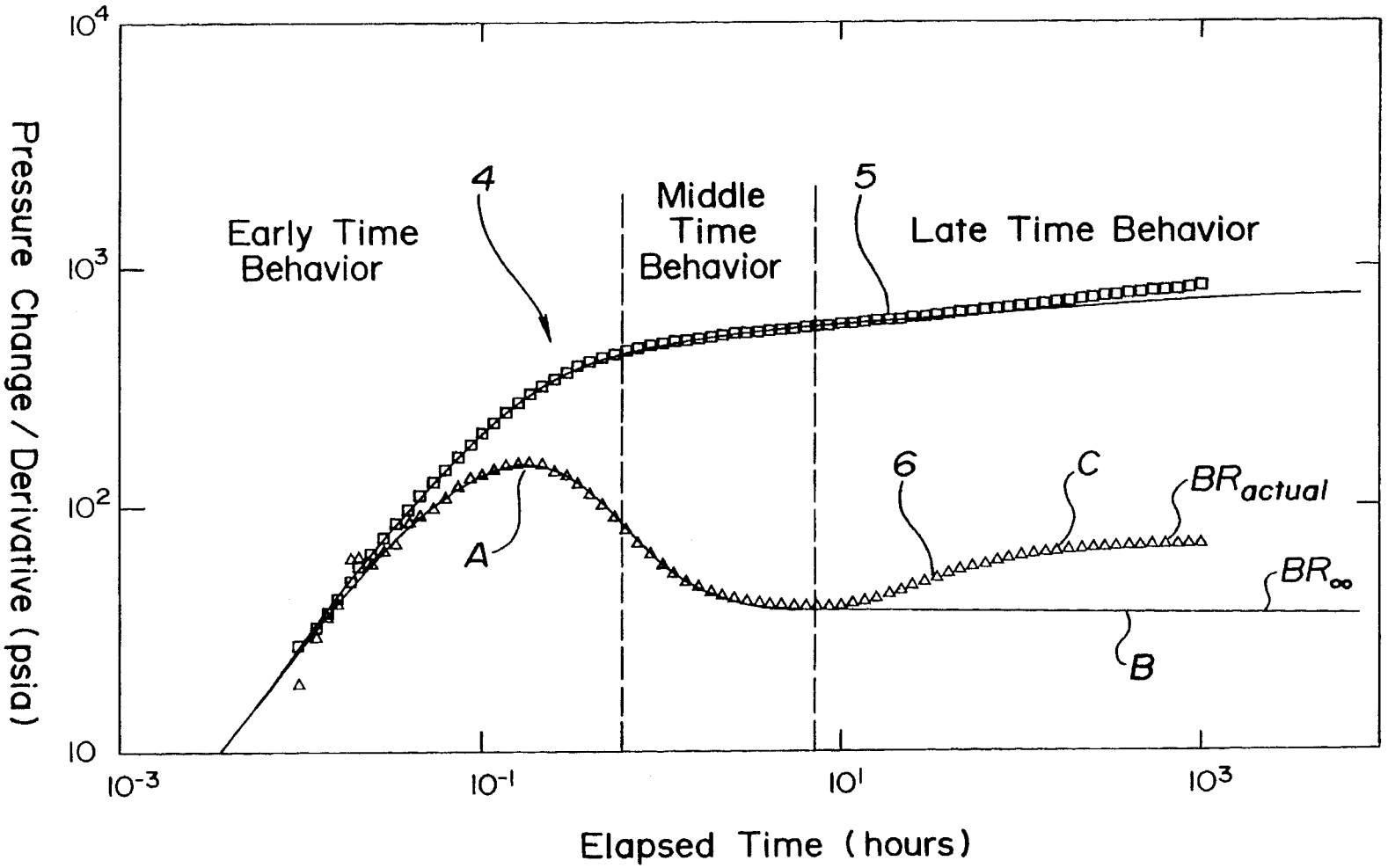
FIG. 2 is a typical Bourdet Type Curve.

Information about the boundaries 3 is determined from an analysis of the rate of the pressure change experienced during the test. At a boundary 3, pressure continues to change but at a more rapid rate than previously. To emphasize the significance of the measured rates of pressure change, the data is generally plotted as the derivative of the pressure with respect to time against elapsed time on a logarithmic scale. This presentation is referred to as a Bourdet Type curve 4. A typical Bourdet Type curve 4 is shown in FIG. 2, showing both the pressure change data curve 5 and the more sensitive pressure change derivative curve 6.

The pressure response curves 5, 6 can be sub-divided as representing early, middle and late time well behavior. The early time behavior is influenced by near wellbore parameters such as storage, skin effect and fractures. The middle time behavior is influenced by reservoir matrix parameters such as porosity and permeability. Both the near and middle time behaviors are reasonably easy to calculate and to substantiate with alternate methods such as core analyses and direct measurement. The late time behavior is representative of boundary effects. The boundary effects generally occur remote from the well and may or may not be subject to verification through seismic data.

Characteristically, the pressure derivative curve 6 rises to peak A, and then diminishes. If the reservoir 2 is an ideal, homogeneous, infinitely extending, radial reservoir, then the trailing end of the curve flattens to approach a constant slope, as shown by curve B. When a boundary 3 is present, the rate of change of the pressure increases and the pressure derivative curve 6 deviates upwards at C from the ideal reservoir curve B. Sometimes, the indications of a boundary are not so obviously defined and can deviate off of the downslope of peak A.

One can segregate the boundary effects by independently determining the pressure response for the early and middle time behavior and dividing them out of the measured response. This ratio of measured and calculated response calculates out to unity for all except the data affected by a boundary. The boundary effects become distinguishable as the value of the ratio deviates from unity.

In order to relate the deviation of the well's pressure response to the physical geometry of the reservoir, relationships of the pressure response as a function of time and geometry are defined. The pressure response behavior of the well 1 during the transient pressure testing can be discretized into many short pulses to represent continuous pressure behavior. This analytical technique is known in the art as the superposition theory in well test analysis. This relates the pressure response as being analogous to a summation of pressure pulses and corresponding pressure waves propagating radially from a well.

Figure 3:
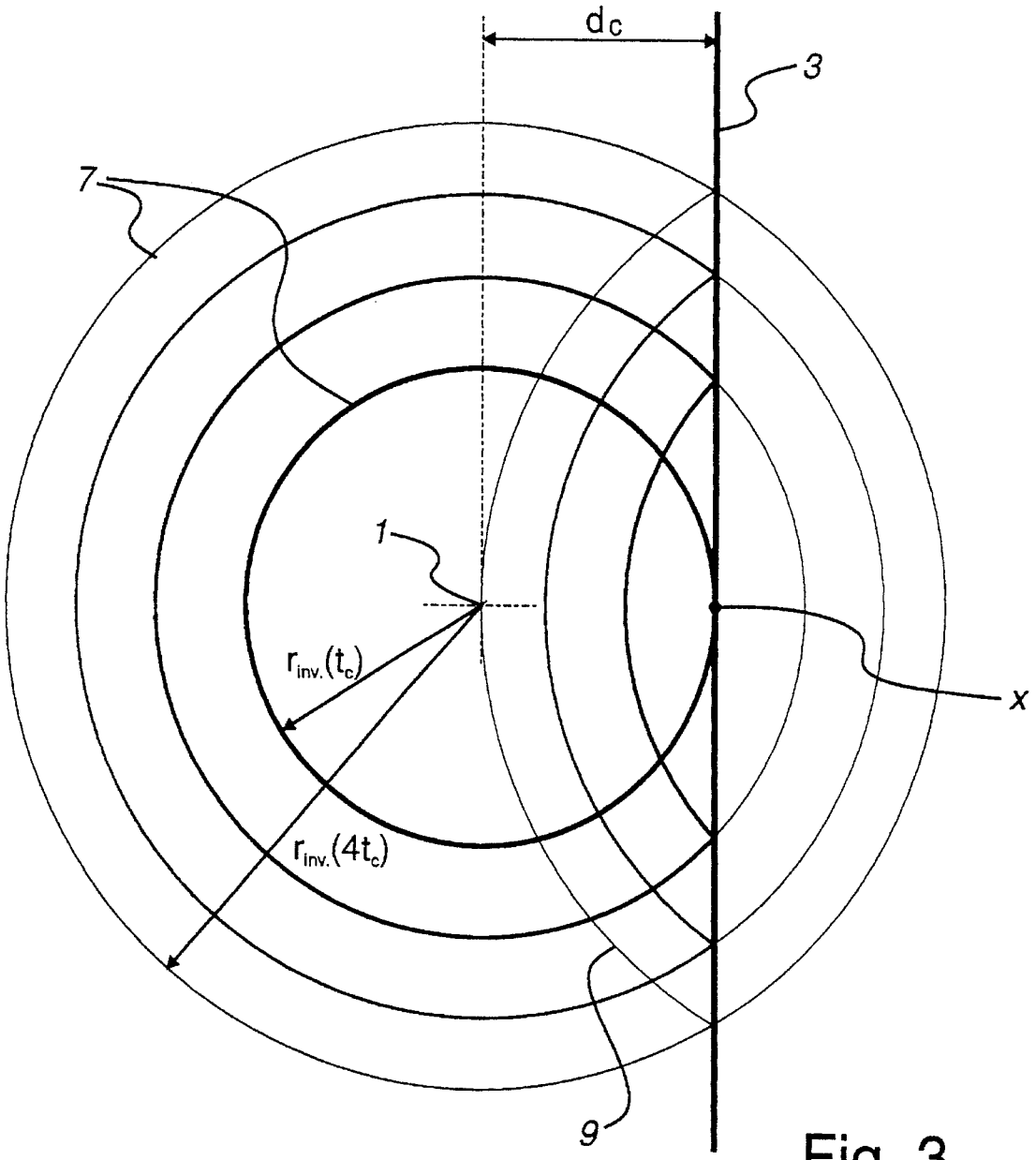
FIG. 3 is a plot showing the analogous pressure wavefronts of the superposition theory in well testing behaviour.

Referring to FIG. 3, an analogous pressure wavefront 7 is seen to travel radially outwards from the well 1. The distance that the wavefront 7 extends from the well, at any time t, is referred to as the radius of investigation and is indicated herein by the terms $r_{inv}(t)$ and $r_{inv}$.

The radius of investigation is a function of specific reservoir parameters and response. It is known that the overall radius of investigation $r_{tot}$ for a reservoir at the conclusion of a test at time $t_{tot}$ may be determined by:

$$r_{tot} = r_{inv}(t_{tot}) = 0.029\sqrt{\frac{kt_{tot}}{\phi\mu c_t}} \quad (1)$$

where k is the reservoir permeability, $\phi$ is the reservoir porosity, $\mu$ is the fluid viscosity, and $c_t$ is the total compressibility.

After a period of time $t_c$ the initial extending wavefront 7 contacts a boundary 3 at its leading edge at point X. At contact, the radius of investigation $r_{inv}(t_c)$ involves a distance $d_c$ from the well.

At this time, in our concept, the wavefront 7 is absorbed and re-emitted from the boundary 3, creating a returning wavefront 9.

Each individual wavefront 7 characteristically travels a smaller radial increment outwards per unit time than its predecessor, related to the square root of the time. Thus, the initial returning wavefront 9 returns to the well at $t=4\times t_c$ having travelled a distance, out to the boundary 3 and back to the well, of $2\times d_c$.

Applying the square root relationship of distance and time to the radius of investigation one may re-write equation 1 as:

$$r_{inv}(t) = r_{tot}\sqrt{\frac{t}{t_{tot}}} \quad (2)$$

The pressure test data does not provide information about the actual contact until such time as the returning wavefront 9 appears back at the well at time $t=4\times t_c$. This time is referred to as the time of information, $t_{inf}$, and is representative of the actual time recorded during the transient test. In order to determine the distance to boundary contact in terms of the time of information $t_{inf}$, one substitutes $t_{inf}=4\times t_c$ into equation 2. Since $r_{inv}$ at $4\times t_c=2\times d_c$, then one must introduce a constant of ½ for $r_{inv}$ ($t_{inf}$) to continue to equal $d_c$. One can then define a new quantity called the radius of information, $r_{inf}$, which compensates for the lag in information from the pressure test data. Therefore, $r_{inf}$ can be defined as:

$$r_{inf}(t) = \frac{r_{tot}}{2}\sqrt{\frac{t}{t_{tot}}} \quad (3)$$

Figure 4:
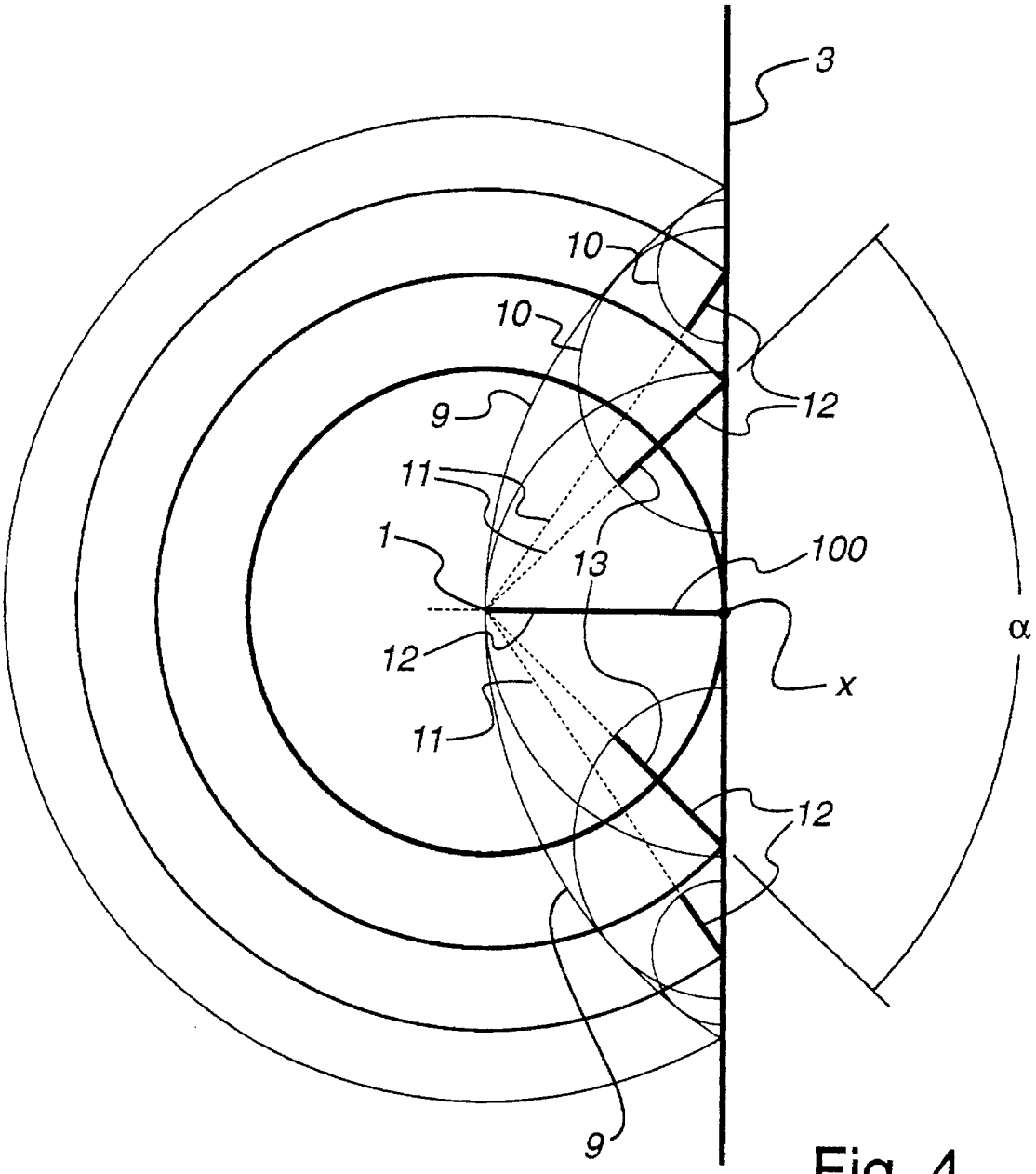
FIG. 4 is a plot of re-emitted wavelets from a boundary.

As the extending wavefront 7 continues to impact a wider area on the boundary, multiple sub-wavefronts or wavelets 10, representing the boundary interactions, are generated. As shown in FIG. 4, each wavelet 10 is a circular arc circumscribed within the initial returning wavefront 9. Each later wavelet 10 is smaller than the preceding wavelet and lags slightly as they were generated in sequence after the initial contact.

Vectors 11 are drawn from the center of each wavelet 10 to the well. Rays 12 are traced along each vector 11, from the center of each wavelet 10 to its circumference. A ray length 12 less than that of the vector 11 indicates that information about the boundary has not yet been received at the well. A contact vector 100 extends between the well 1 and the point of contact X.

The length of each vector 11 provides information about the distance from the well to the boundary. Referring to FIG. 4, a ray 12 drawn in the initial returning wavefront 9 (at $t=4\times t_c$) is equal to the length of the contact vector 100 and the distance to the boundary $d_c$. When each ray 12 in turn reaches the well 1, as defined by the pressure test elapsed time t, its length is equal to the radius of information $r_{inf}(t)$. Pressure and time data acquired during the transient pressure test are input to equation 3 to calculate the radius of information $r_{inf}$ for each data pair.

The orientation of each vector 11 indicates in which direction the boundary lies. The included angle between a pair of rays 13, formed from the two vectors 11 which are generated simultaneously when the wavefront 7 contacts the boundary 3, is defined as an angle-of-view $\alpha$. As the wavefront 7 progressively widens, the ray pair 13 contacts a greater portion of the boundary 3, and the angle-of-view $\alpha$ increases. The angle-of-view is integral to determining the location of the boundary 3.

In order to relate the angle-of-view to actual reservoir characteristics, the timing and spacing of the discretized wavefronts 7 must be known. This information is obtained from the directly measured pressure response data from the well 1 and portrayed in the Bourdet Response Curve 4.

The relationship of the angle-of-view and the pressure response curve can be expressed as:

$$\frac{BR_{actual}}{BR_{\infty}} = \frac{1}{\left(1-\frac{\alpha}{360°}\right)} \quad (4)$$

where $BR_{\infty}$ is the ideal Bourdet Response Curve for an infinite reservoir and $BR_{actual}$, is the actual Bourdet Response (FIG. 2). This relationship has not heretofore appeared in the art and is hereinafter referred to as the Bourdet Ratio.

One may see that when the angle-of-view $\alpha$ is zero, indicative of no boundary being met, the Bourdet Ratio $BR_{actual}/BR_{\infty}=1$ (unity). When G approaches 360 degrees, indicative of a closed boundary reservoir, both the actual pressure response and the Bourdet Ratio increase to infinity.

It will now be shown that the Bourdet Response Curve provides information necessary to determine the distance and orientation of reservoir boundaries having calculated values representing the angle-of-view $\alpha$ (equation 4) and the radius of information $r_{inf}$ (equation 3).

Several types of boundary orientations can be modelled: the Angular Image model; the Balanced Image model; and the Channel-Form Image model. Each model results in the determination of a separate image of the reservoir boundaries. One image is chosen as being representative, much like only one real result might be selected from the solution to a quadratic equation.

Figure 5:
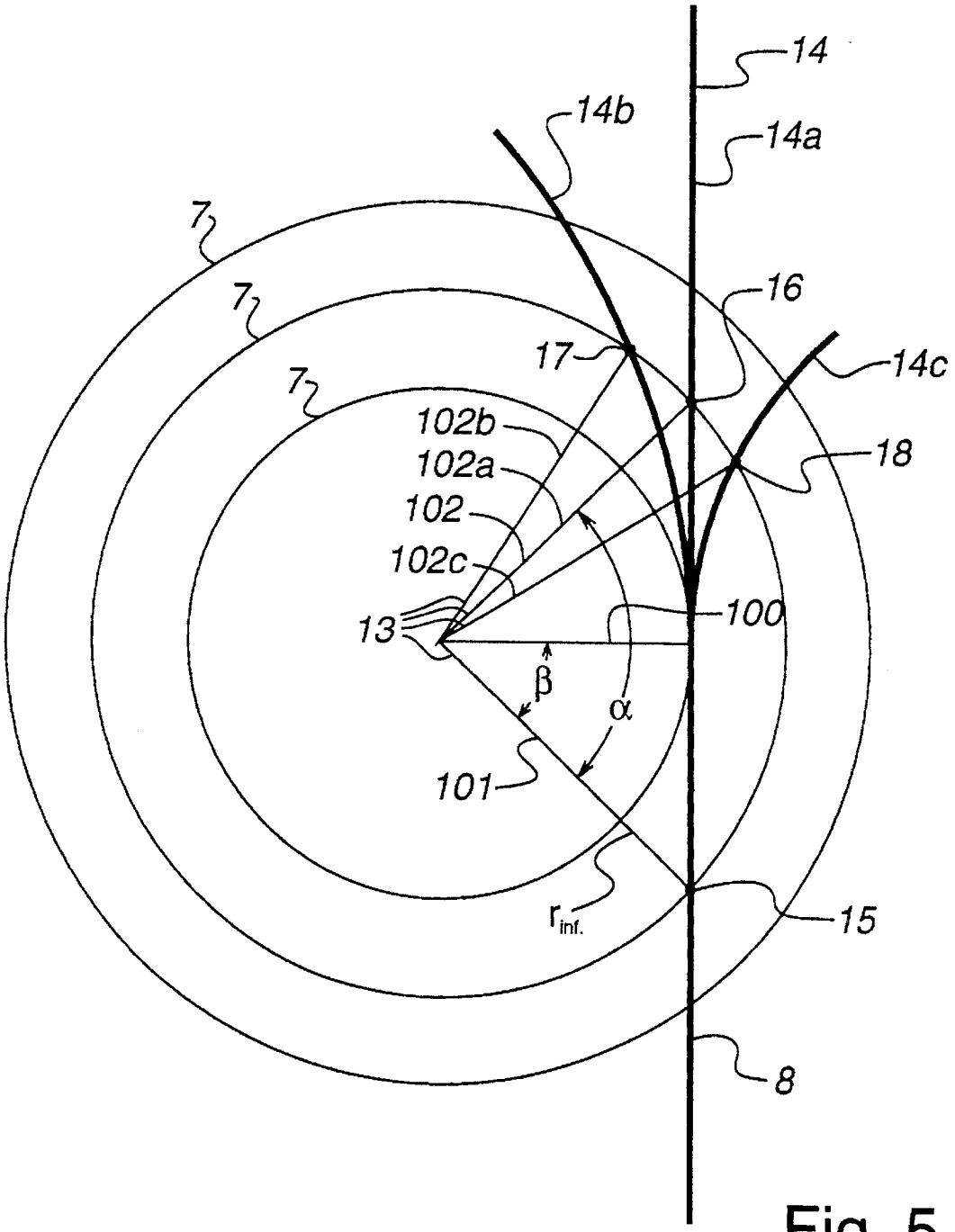
FIG. 5 demonstrates the determination of boundary coordinates according to the Angular Image Model.

Referring to FIG. 5, a simple Angular Image model is presented showing the extending wavefront 7 as contacting a boundary formed of two distinct portions. A flat boundary portion 8 extends in one direction, tangent to the point of contact X. The remaining boundary portion 14 extends in the opposite direction in one of either a flat 14*a*, concave curved 14*b*, or a convex curved 14*c* orientation. The exact orientation of boundary portion 14 is determined by applying the angle-of-view principle to the assumed geometry of boundary portion 8.

One ray pair 13 is located by determining vectors 101 and 102 which represent the intersections of the points of contact of one wavefront 7 and boundary portions 8 and 14 respectively. Ray pairs 13 can be located for each successive contact of the wavefront 7 with the boundary portions 8, 14, only one of which is shown on FIG. 5. At this point, vector 102 (one half of the ray pair 13) could be oriented to any of three different directions 102*a*, 102*b* or 102*c* dependent upon the actual boundary 14 orientation 14*a*, 14*b* or 14*c* respectively.

Vector 101 is determined geometrically by determining the intersection 15 of the radius of information $r_{inf}$ with the flat boundary 8 for each ray pair 13. An angle beta β is defined which orients the intersecting vector 101 from the contact vector 100. The β is determined as:

$$\beta = \arccos\left(\frac{d_c}{r_{inf}}\right) \tag{5}$$

The vector 102, for each ray pair 13, is located on the boundary 14 by application of the angle-of-view α.

The angle-of-view α is determined from the pressure response data and equation 4. The vector 102 is then located by rotating it through an angle-of-view relative to the intersecting vector 101 at a distance $r_{inf}$ from the well 1.

If the angle-of-view α is greater than 2×β, then the vector 102*b* is seen to contact the concave boundary 14*b* at a boundary coordinate 17. Conversely, if α is less than 2×β, then the vector 102*c* is seen to contact the convex boundary 14*c* at a boundary coordinate 18.

If the angle-of-view α is equal to twice the β angle then the boundary 14 is seen to be flat. The locating vector 102*a* then intersects the flat boundary 14*a* at a boundary coordinate 16, mirror opposite the intersection 15 from the point of contact X. The angle-of-view α is then equivalent to 2×β, or:

$$\alpha = 2 \cdot \arccos\left(\frac{d_c}{r_{inf}}\right) \tag{6}$$

Coordinates 15 and either 16, 17 or 18 are successively calculated for each ray pair 13, corresponding to each pressure test data pair, to assemble a two-dimensional aerial image of the bounded reservoir 2. The actual trigonometric relationships used to calculate the coordinates for all model forms are presented in Example I.

Figure 6:
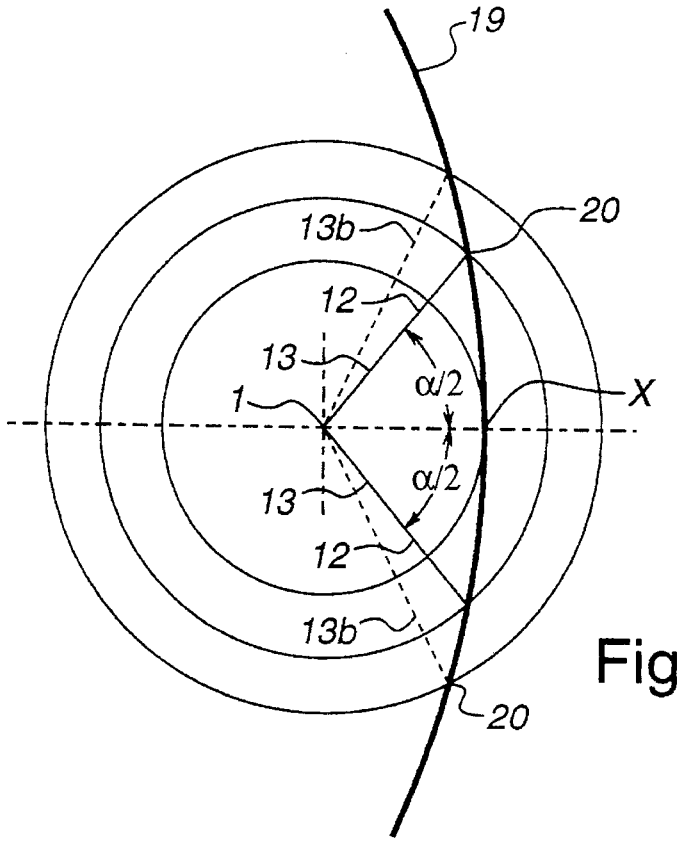
FIG. 6 demonstrates the determination of boundary coordinates according to the Balanced Image Model.

For the Balanced Image model, as shown in FIG. 6, a boundary 19 is assumed to extend in a mirror-image form, balanced either side of the point of contact X. Each vector 11, or ray 12 of the ray pair 13 is equi-angularly rotated either side of the point of contact X at an angle equal to one half the angle-of-view, α/2, and at a distance $r_{inf}$, thereby defining the location of a boundary coordinate 20. Coordinates may be similarly calculated for each ray pair 13, 13*b* and so on.

Figure 7:
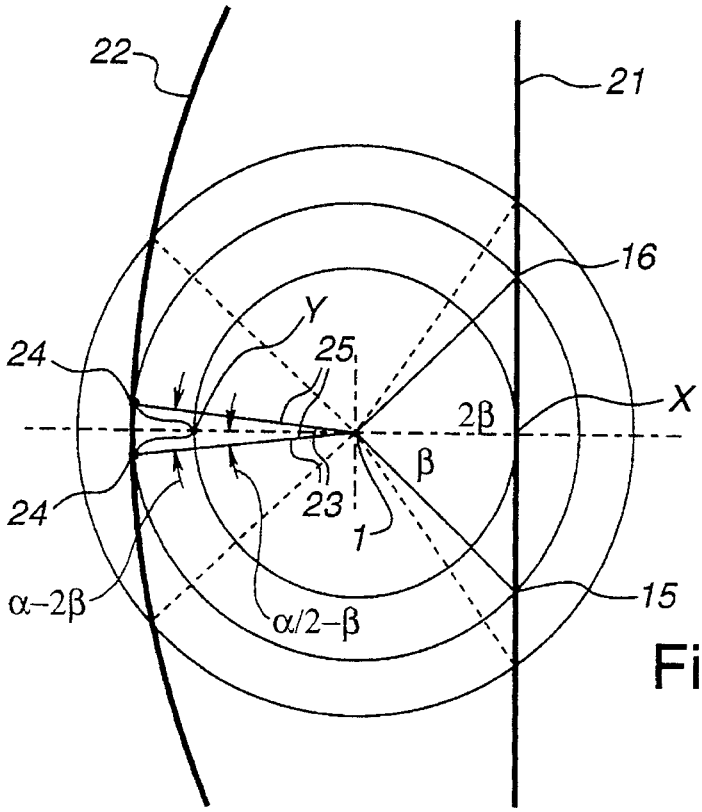
FIG. 7 demonstrates the determination of boundary coordinates according to the Channel-Form Image Model.

Referring to FIG. 7, for the Channel-Form Image model, the angle-of-view α is assumed to be greater than 2×β. It is assumed that two boundaries exist: one being a flat boundary 21 at distance $d_c$, tangent to the point of contact X; and the other being a balanced boundary 22. The balanced boundary 22 has a balanced, mirror image form and begins at a point Y, located on the mirror opposite side of the well 1 from the point of contact X. The orientation of coordinates on the balanced boundary 22 are determined by subtracting 2×β (being the flat boundary contribution) from the angle-of-view α and applying the difference (α−2β) as the included angle between a second pair of vectors 23. The vector pair 23 equally straddles the mirror point Y. Each vector 25 of the vector pair 23 is equi-angularly rotated at a distance $r_{inf}$ and an angle of α/2−β from mirror point Y to locate balanced boundary coordinates 24. The flat boundary coordinates 15, 16 are determined as previously shown for the Angular Image model.

The variety of choices of the model that one uses to ultimately describe the boundaries can be narrowed, first by eliminating some choices based on the angle-of-view, and second by comparing the resulting images against known geological data such as seismic data and maps, or by comparison with images from nearby wells. The comparison of adjacent well images is analogous to fitting together pieces of a jigsaw puzzle.

The magnitude of the angle-of-view with respect to the β angle, as calculated for the Angular model, can indicate whether the reservoir may have a single curved, single flat or multiple boundaries. Table 1 narrows the selection of the useful model forms to those as indicated with an "X".

TABLE 1

| Model | α = 2β | α > 2β | α < 2β |
|---|---|---|---|
| Angular | | | |
| Flat | X | — | — |
| Concave | — | X | — |
| Convex | — | — | X |
| Balanced | X | X | X |
| Channel-Form | — | X | — |

By repeating the above procedure for multiple layers of a reservoir existing at different elevations, a three dimensional image can be assembled.

Determination of the images described hereinabove requires systematic reduction of the well pressure response data to boundary coordinates. Illustration of the practical reduction of this data is most readily portrayed with an actual example as presented in Example I.

In an alternative application of the method herein described, one may predict the Bourdet Ratio and a Bourdet type derivative curve for a reservoir 2 of constant thickness, given an arbitrary set of boundaries and the reservoir parameters.

For the simplest case of a single fiat boundary, equations 1, 4 and 6 can be combined to result in:

$$\frac{BR_{flatBndry}}{BR_{\infty}} = \frac{360}{\left(360 - 2\arccos\left(\frac{d_c}{0.029\sqrt{\frac{kt}{\phi\mu c_t}}}\right)\right)} \tag{7}$$

By applying the Bourdet Ratio to the known calculated response for a homogeneous and infinitely radial system with the known reservoir parameters, one can predict a Bourdet Type Curve.

In the situation where the boundaries 3 are of an arbitrary shape, the determination of the Bourdet ratio is somewhat more difficult.

One inserts the known reservoir parameters of k, μ, ϕ, and $c_t$, and the known distance to the furthest boundary location of interest (overall radius of investigation $r_{tot}$) into equation 1 to calculate the required overall test $t_{tot}$.

One then can choose a level of precision (increment of time) with which one wishes to determine the predicted Bourdet Ratio versus elapsed time. Radii of investigation are calculated using equation 2 at each increment of time t according to the precision desired.

The radius of investigation is incrementally increased ever outward from the well 1. At each radius of investigation, contact with a boundary is determined by checking for intersections of the radius of investigation and the boundary 3. The included angle between vectors extending between each intersection and the well is used as the angle-of-view. Until the wavefront reaches a boundary, the angle-of-view α is calculated as zero.

Each angle-of-view is inserted into equation 4 to calculate a Bourdet Ratio for each increment of time. Thus one data pair of elapsed time and the Bourdet Ratio is calculated for each increment of time.

Finally, all that remains is to calculate the corresponding ideal Bourdet response for that reservoir and to apply the Bourdet Ratio to it, thereby incorporating the near-wellbore and reservoir matrix effects.

Two illustrative examples are provided. In a first example, actual transient well test data is presented and the reservoir boundaries are determined. The predicted boundaries are overlaid onto known seismic-determined boundaries for validation. In a second example, reservoir boundaries are provided and the Bourdet ratio as a function of well response time is predicted.

EXAMPLE I

A well and reservoir was subjected to a transient pressure build-up test and was determined to have the following characteristics shown in Table 2:

TABLE 2

| Parameter | | Value | Units |
|---|---|---|---|
| Reservoir Thickness | | 8.00 | m |
| Wellbore Radius | | 90.00 | Mm |
| Oil Viscosity | μ | 0.428 | Pa.s |
| Total Compressibility | $c_t$ | 2.56e | 061/kPa |
| Matrix Porosity | ϕ | 0.185 | fraction |
| Permeability | k | 537.9 | md |

Figure 8:
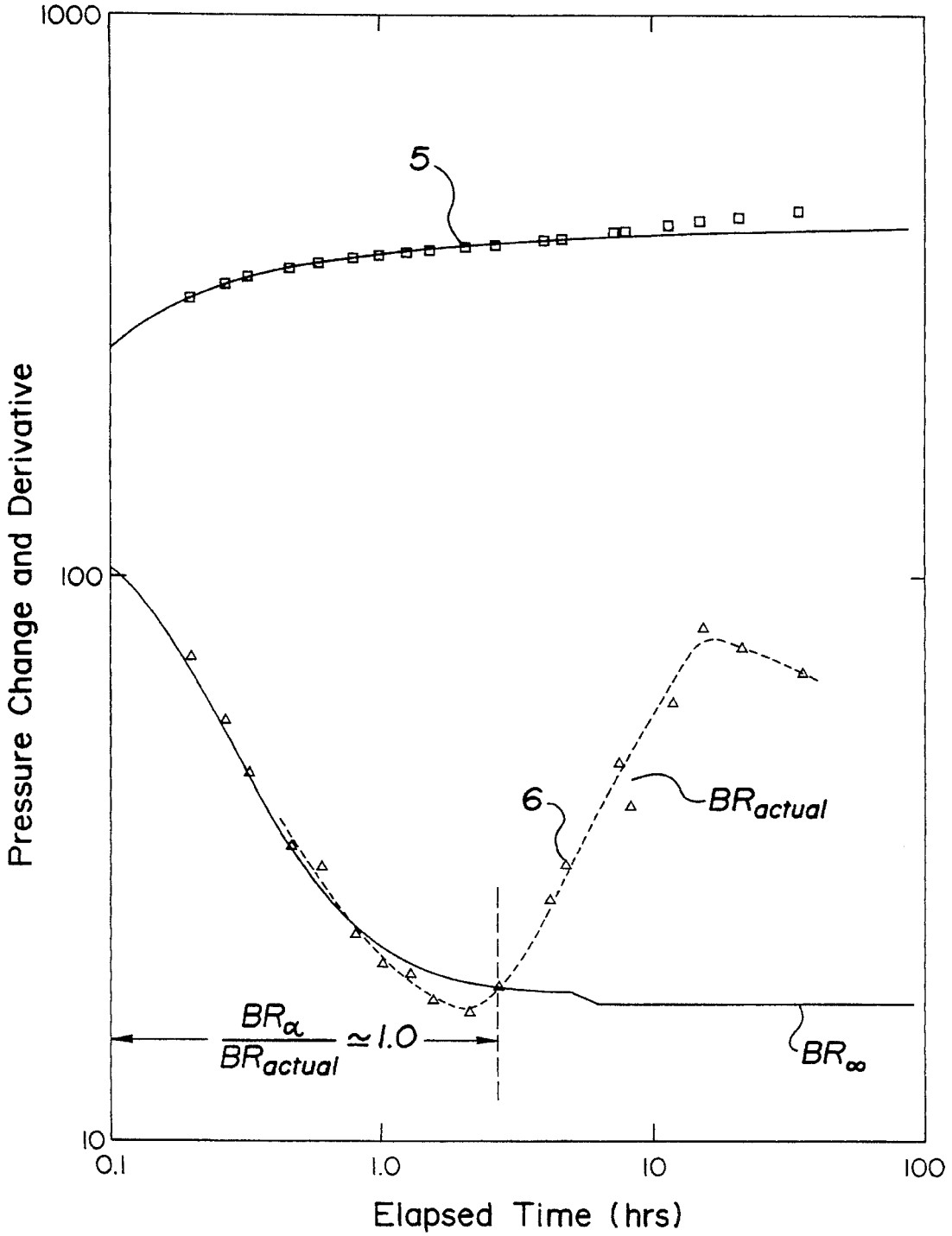
FIG. 8 presents the pressure response data for a sample well and reservoir according to Example I.

Table 3 presents the elapsed time and pressure data recorded for an overall 34.6 hour period. The pressure change 5 from the initial pressure and the actual Bourdet Response Curve derivative 6 were determined as displayed on FIG. 8.

TABLE 3

| Elapsed Time *data* [hours] | Pressure History *data* [kPa] | Actual Bourdet *data* Deriv. | Infinite Bourdet *data* Deriv | Bourdet Ratio $BR_{oc}$ / $Br_{actual}$ | Angle of View alpha *Eqn 4* [degs] | Open Angle [degs] | Radius of Info *Eqn 3* [feet] |
|---|---|---|---|---|---|---|---|
| 0.0000 | 5384.816 | | | | | | |
| 0.1999 | 5698.823 | 74.5504 | 67.0641 | 1.1116 | 0.00 | 360.00 | 127.23 |
| 0.2699 | 5717.098 | 55.5549 | 52.1669 | 1.0649 | 0.00 | 360.00 | 147.83 |
| 0.3295 | 5727.960 | 43.0552 | 43.6737 | 0.9858 | 0.00 | 360.00 | 163.35 |
| 0.3997 | 5733.487 | 33.7793 | 36.6200 | 0.9224 | 0.00 | 360.00 | 179.89 |
| 0.4698 | 5738.418 | 32.6132 | 32.4838 | 1.0040 | 0.00 | 360.00 | 195.04 |
| 0.5299 | 5742.334 | 32.4803 | 29.7418 | 1.0921 | 0.00 | 360.00 | 207.14 |
| 0.5997 | 5745.960 | 26.9604 | 27.6316 | 0.9757 | 0.00 | 360.00 | 220.36 |
| 0.6698 | 5748.426 | 29.4472 | 25.8465 | 1.1393 | 0.00 | 360.00 | 232.87 |
| 0.7991 | 5753.357 | 25.6707 | 23.8760 | 1.0752 | 0.00 | 360.00 | 254.36 |
| 0.9984 | 5757.273 | 20.6398 | 21.8788 | 0.9434 | 0.00 | 360.00 | 284.31 |
| 1.1989 | 5760.174 | 19.7976 | 20.9000 | 0.9473 | 0.00 | 360.00 | 311.57 |
| 1.2702 | 5761.769 | 19.8299 | 20.5665 | 0.9642 | 0.00 | 360.00 | 320.69 |
| 1.5279 | 5764.670 | 19.4608 | 19.9198 | 0.9770 | 0.00 | 360.00 | 351.73 |
| 2.0697 | 5768.731 | 16.8821 | 19.0762 | 0.8850 | 0.00 | 360.00 | 409.36 |
| 2.6682 | 5772.067 | 17.8173 | 18.6473 | 0.9555 | 0.00 | 360.00 | 464.80 |
| 3.4683 | 5775.548 | 22.5437 | 18.4560 | 1.2215 | 65.28 | 294.72 | 529.92 |
| 4.1309 | 5778.594 | 28.0844 | 18.3325 | 1.5319 | 125.00 | 235.00 | 578.33 |
| 4.7214 | 5781.059 | 31.6163 | 18.2626 | 1.7312 | 152.05 | 207.95 | 618.29 |
| 5.8698 | 5785.556 | 36.2675 | 17.4002 | 2.0843 | 187.28 | 172.72 | 689.39 |
| 7.3945 | 5790.922 | 46.2267 | 17.4002 | 2.6567 | 224.49 | 135.51 | 773.77 |
| 8.1235 | 5792.517 | 49.3488 | 17.4002 | 2.8361 | 233.07 | 126.93 | 811.01 |
| 10.2674 | 5798.464 | 55.0129 | 17.4002 | 3.1616 | 246.13 | 113.87 | 911.77 |
| 11.7157 | 5802.380 | 65.4692 | 17.4002 | 3.7626 | 264.32 | 95.68 | 973.96 |
| 13.5235 | 5806.296 | 67.5887 | 17.4002 | 3.8844 | 267.32 | 92.68 | 1046.40 |
| 15.1786 | 5810.357 | 77.2789 | 17.4002 | 4.4413 | 278.94 | 81.06 | 1108.59 |
| 15.8699 | 5811.372 | 77.3421 | 17.4002 | 4.4449 | 279.01 | 80.99 | 1133.55 |
| 17.0926 | 5806.876 | 68.4220 | 17.4002 | 3.9323 | 268.45 | 91.55 | 1176.41 |
| 17.9005 | 5811.372 | 77.7221 | 17.4002 | 4.4667 | 279.40 | 80.60 | 1203.89 |
| 17.9893 | 5811.372 | 77.9128 | 17.4002 | 4.4777 | 279.60 | 80.40 | 1206.87 |
| 18.4399 | 5812.823 | 74.8555 | 17.4002 | 4.3020 | 276.32 | 83.68 | 1221.90 |
| 20.8338 | 5815.288 | 73.7628 | 17.4002 | 4.2392 | 275.08 | 84.92 | 1298.79 |
| 21.2502 | 5815.723 | 76.4001 | 17.4002 | 4.3908 | 278.01 | 81.99 | 1311.71 |
| 21.6750 | 5817.319 | 77.2789 | 17.4002 | 4.4413 | 278.94 | 81.06 | 1324.75 |

TABLE 3-continued

| Elapsed Time *data* [hours] | Pressure History *data* [kPa] | Actual Bourdet *data* Deriv. | Infinite Bourdet *data* Deriv | Bourdet Ratio $\frac{BR_{oe}}{Br_{actual}}$ | Angle of View alpha *Eqn 4* [degs] | Open Angle [degs] | Radius of Info *Eqn 3* [feet] |
|---|---|---|---|---|---|---|---|
| 22.7746 | 5819.204 | 119.0555 | 17.4002 | 6.8422 | 307.39 | 52.61 | 1357.94 |
| 24.0486 | 5821.235 | 96.6665 | 17.4002 | 5.5555 | 295.20 | 64.80 | 1395.40 |
| 27.4407 | 5821.815 | 87.2110 | 17.4002 | 5.0121 | 288.17 | 71.83 | 1490.57 |
| 28.2211 | 5823.265 | 77.3421 | 17.4002 | 4.4449 | 279.01 | 80.99 | 1511.62 |
| 31.1055 | 5824.281 | 104.2971 | 17.4002 | 5.9940 | 299.94 | 60.06 | 1586.99 |
| 33.6683 | 5826.166 | 251.4144 | 17.4002 | 14.4490 | 335.08 | 24.92 | 1651.07 |
| 34.5686 | 5827.761 | 300.6708 | 17.4002 | 17.2798 | 339.17 | 20.83 | 1673.00 |

The Bourdet Response $BR_{\infty}$ for an infinite acting reservoir was calculated with conventional methods. The infinite Bourdet Response and the actual Bourdet response $BR_{actual}$ were divided to remove the near wellbore and matrix behavior. The resulting Bourdet Ratio evaluated to about 1.0 until an elapsed time of 2.6682 hours. The Bourdet Ratio thereafter deviated from the ideal infinite response ratio of unity, indicating the presence of boundary effects.

Once a boundary was detected, the angle-of-view α was calculated using a rearranged equation 4 as follows:

$$\alpha = 360^{\circ}\left(1 - \frac{1}{\left(\frac{BR_{\infty}}{BR_{a}}\right)}\right) \tag{8}$$

The known reservoir parameters were used to calculate the overall radius of investigation $r_{tot}$. The total test time of 34.6 hours and the incremental recorded times were inserted into equation (3) to calculate the radius of information at each time increment.

The radius of information was 464.8 feet when the Bourdet Ratio deviated from 1.0 and therefore was used as the distance $d_c$ to the boundary contact point X.

A cartesian coordinate system was overlaid on the well with the origin at the well center 1 with coordinates of (0,0). A line tangent to the radius of information at the contact point X was placed at a constant 464.8 feet on the X axis, representing the boundary.

Using the Angular Image model, vectors were determined between the well center and the intersection of each radius of information and the tangent boundary region. Each vector 11 was assigned the magnitude of the corresponding radius of information and the direction was determined with the β angle in degrees:

$$\beta = \arccos\left(\frac{464.80}{r_{inf}}\right) \tag{9}$$

Figure 9:
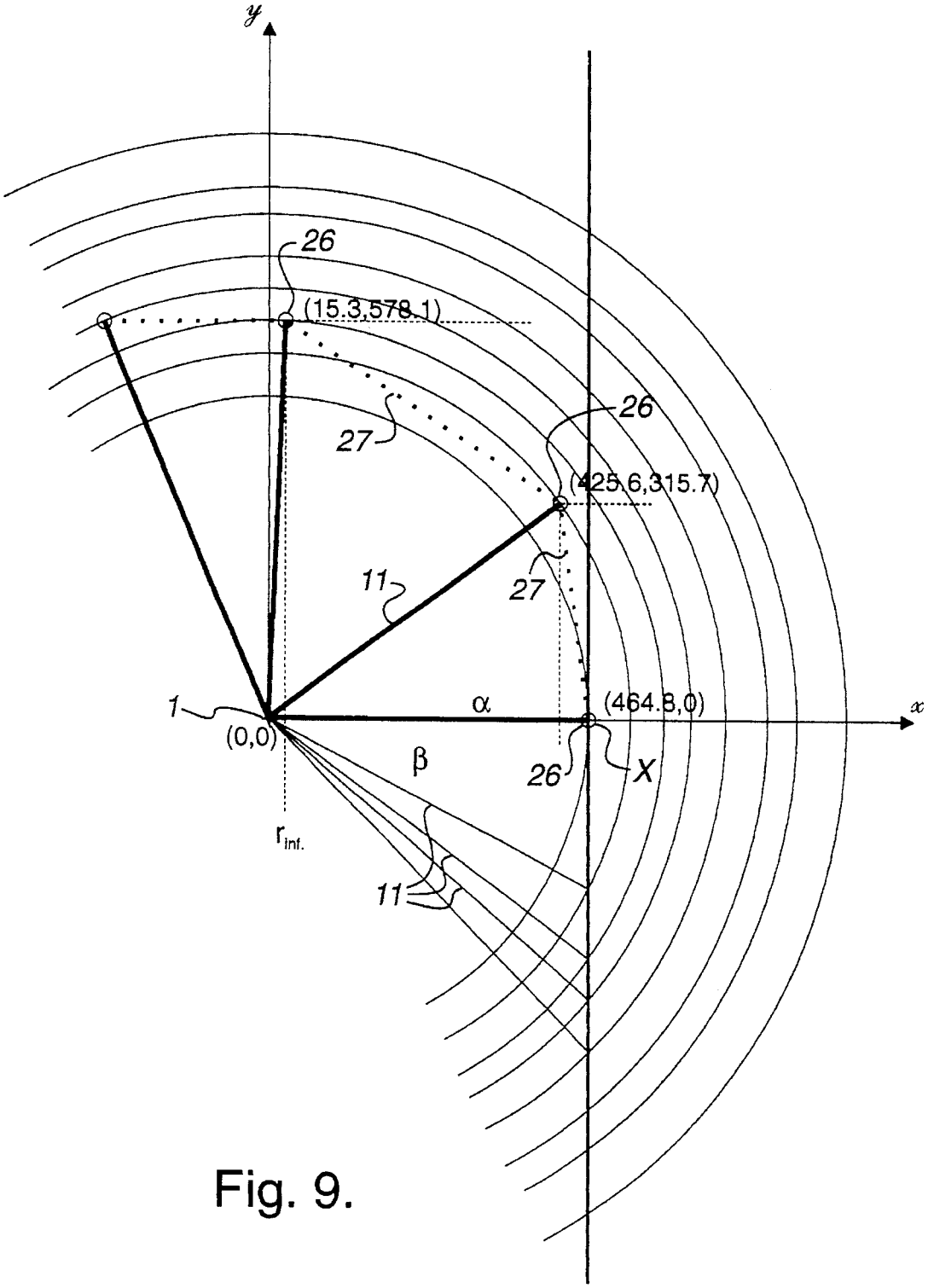
FIG. 9 presents the determination of the first three boundary coordinates for the data of Example I according to the Angular Image model.

Referring to FIG. 9, boundary coordinates were located by sweeping the vector representing each radius of investigation about the well center, an angle α from the vector 11, and calculating its endpoint in space geometrically. The x and y coordinates were calculated as:

$$x_{b1}=d_c \quad y_{b1}=r_{inf}\sin(\alpha-\beta) \tag{10}$$

$$x_{b2}=r_{inf}\cos(\alpha-\beta) \quad y_{b2}=r_{inf}\sin(\alpha-\beta) \tag{11}$$

FIG. 9 shows the first three boundary coordinates identified with circular points connected by a dotted boundary line. Table 4 presents the corresponding boundary coordinates for each pressure test data pair.

TABLE 4

| E-lapsed Time *data* [hours] | Boundary Region Tangent *Eqn 10* x-coord | Rad of Inf ary From dc B *Eqn 5* [degs] | Bound-Region Intersect *Eqn 10* y-coord | Angular Image Model Boundary Coordinates *Eqn 11* x-coord | *Eqn 11* y-coord |
|---|---|---|---|---|---|
| 0.0000 | | | | | |
| 2.6682 | 464.80 | 0.00 | 0.00 | 464.80 | 0.00 |
| 3.4683 | 464.80 | 28.70 | −254.52 | 425.59 | 315.74 |
| 4.1309 | 464.80 | 36.52 | −344.14 | 15.26 | 578.13 |
| 4.7214 | 464.80 | 41.26 | −407.73 | −219.51 | 578.01 |
| 5.8698 | 464.80 | 47.61 | −509.14 | −525.58 | 446.13 |
| 7.3945 | 464.80 | 53.08 | −618.61 | −765.09 | 115.54 |
| 8.1235 | 464.80 | 55.03 | −664.61 | −810.53 | 27.84 |
| 10.2674 | 464.80 | 59.35 | −784.40 | −905.39 | −107.70 |
| 11.7157 | 464.80 | 61.50 | −855.89 | −897.69 | −377.81 |
| 13.5235 | 464.80 | 63.63 | −937.51 | −958.21 | −420.47 |
| 15.1786 | 464.80 | 65.21 | −1006.45 | −921.97 | −615.59 |
| 15.8699 | 464.80 | 65.79 | −1033.88 | −948.35 | −620.95 |
| 17.0926 | 464.80 | 66.73 | −1080.70 | −1092.88 | −435.39 |
| 17.9005 | 464.80 | 67.29 | −1110.55 | −1019.67 | −640.02 |
| 17.9693 | 464.80 | 67.35 | −1113.78 | −1020.65 | −644.06 |
| 18.4399 | 464.80 | 67.64 | −1130.04 | −1072.03 | −586.33 |
| 20.8338 | 464.80 | 69.03 | −1212.77 | −1166.87 | −570.33 |
| 21.2502 | 464.80 | 69.25 | −1226.60 | −1149.86 | −631.18 |
| 21.6750 | 464.80 | 69.46 | −1240.54 | −1153.21 | −651.97 |
| 22.7746 | 464.80 | 69.98 | −1275.92 | −731.59 | −1144.02 |
| 24.0486 | 464.80 | 70.54 | −1315.72 | −992.61 | −980.75 |
| 27.4407 | 464.80 | 71.83 | −1416.25 | −1200.63 | −883.33 |
| 28.2211 | 464.80 | 72.09 | −1438.38 | −1347.86 | −684.28 |
| 31.1055 | 464.80 | 72.97 | −1517.40 | −1082.92 | −1160.10 |
| 33.6683 | 464.80 | 73.65 | −1584.30 | −245.89 | −1632.66 |
| 34.5686 | 464.80 | 73.87 | −1607.14 | −137.18 | −1667.37 |

Figure 10A:
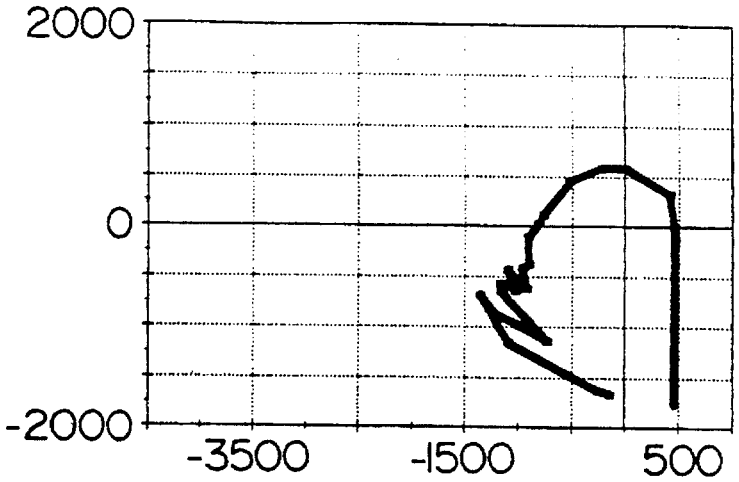
FIG. 10*a*, 10*b* and 10*c* present the calculated boundary image results according to the Angular, the Balance, and the Channel-Form Image models respectively.
Figure 10B:
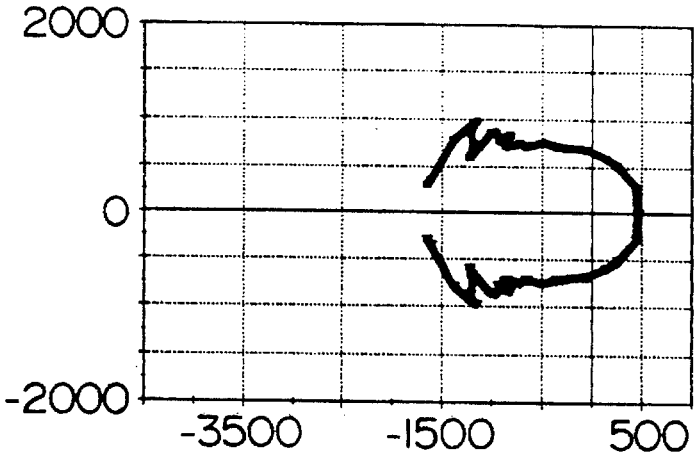
Figure 10C:
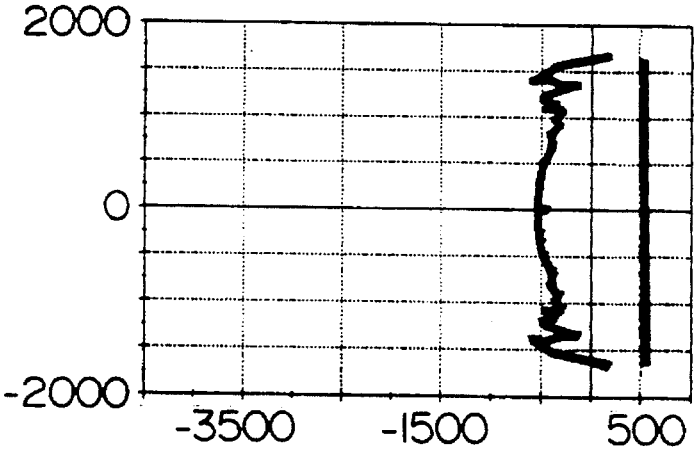

FIG. 10*a* shows the entire boundary plotted for all the data points. FIGS. 10*b* and 10*c* present the boundary as determined using the Balanced and Channel-Form models.

The Balanced model was determined by calculating the boundary CCW and CW from the point of contact. The coordinates were determined using:

$$x_{ccw} = r_{inf}\cos\left(\frac{\alpha}{2}\right) \quad y_{ccw} = r_{inf}\sin\left(\frac{\alpha}{2}\right) \tag{12}$$

$$x_{cw} = r_{inf}\cos\left(-\frac{\alpha}{2}\right) \quad y_{cw} = r_{inf}\sin\left(-\frac{\alpha}{2}\right) \tag{13}$$

The Channel-Form model was determined by first calculating the fiat boundary portion as:

$$x_{f1}=d_c \quad y_{f1}=-r_{inf}\sin(\beta) \tag{14}$$

$$x_{f2}=d_c \quad y_{f2}=r_{inf}\sin(\beta) \tag{15}$$

and the balanced portion of the boundary as:

$$x_{b1} = r_{inf} \cos\left(\frac{\alpha}{2} - \beta\right) \quad y_{b1} = r_{inf} \sin\left(\frac{\alpha}{2} - \beta\right) \tag{16}$$

$$x_{b2} = r_{inf} \cos\left(\frac{\alpha}{2} - \beta\right) \quad y_{b2} = -r_{inf} \sin\left(\frac{\alpha}{2} - \beta\right) \tag{17}$$

Figure 11:
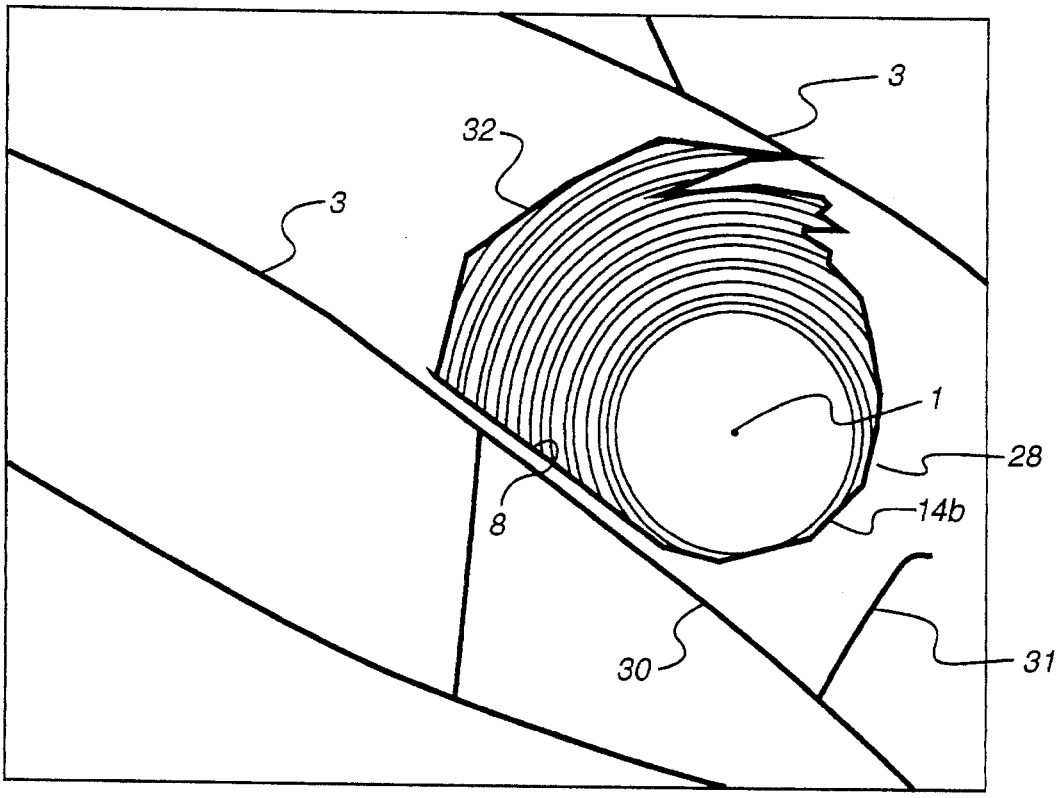
FIG. 11 shows the best match of the boundary image as calculated with the Angular Image model, overlaying the seismic-determined boundary.

The results of the three models were reviewed for a physical fit with the existing seismic data as presented in FIG. 1. Referring to FIG. 11, the Angular Image model results 28, as presented in FIG. 10*a* provided the best fit and were overlaid onto the seismic data map of FIG. 1. The scales of the image and of the seismic map were identical.

The well 1 of the image 28 was aligned with the well 1 of the seismic map. The image was then rotated about the well to visually achieve a best match of the image boundaries and the seismic-determined boundaries.

The fiat boundary portion 8 of the image 28 aligned well with a relatively flat seismic-determined boundary 30. The concave curved boundary 14*b* of the image then corresponded nicely with another seismic-determined boundary 31. The remaining image fit acceptably within the other constraining seismic map boundaries 3.

The image boundaries were seen to be somewhat more restrictive than could be interpreted by the seismic data along. The trailing portion 32 of the image boundary 14*b* reveals a heretofore unknown boundary, missed entirely by the seismic map.

EXAMPLE II

Figure 12:
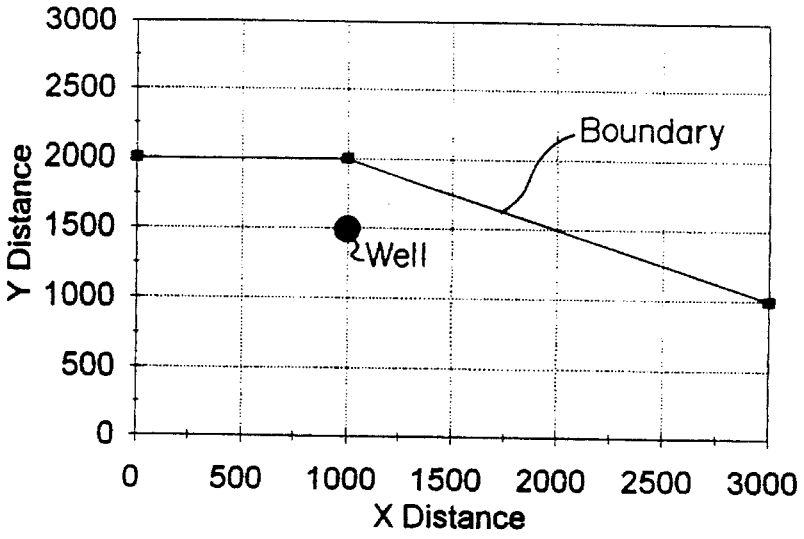
FIG. 12 is an arbitrary boundary and well arrangement according to Example II.

A simple reservoir comprising two linear boundaries was provided as shown in FIG. 12.

A program RBOUND.BAS was developed to demonstrate the steps required to predict the Bourdet Ratio for the reservoir. The program was run using the sample well and boundary coordinate file SAMPLE.BND. This program is appended hereto as FIG. 14 in the appendix. The overall test duration was chosen as 1000 hours with a corresponding overall radius of investigation having been previously determined to be 2000 distance units. An output tolerance or precision was input as 1 hour, thereby providing one data pair per hour of elapsed test time.

Figure 13:
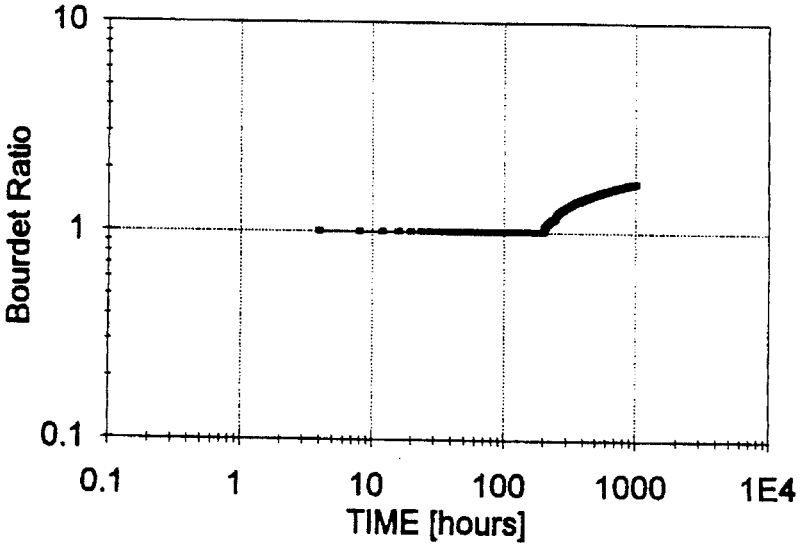
FIG. 13 is the calculated Bourdet Ratio results according to the well and boundary image as provided in FIG. 12.

The Bourdet Ratio was calculated as the program output and is plotted as seen in FIG. 13. One has only to multiply the known ideal Bourdet Response by the Bourdet Ratio to obtain the predicted Bourdet Response Curve for the given well, reservoir and boundaries.

```
DECLARE SUB ScaleSCR (X!, Y!, xpos!, ypos!, xmin!, xmax!, ymin!, ymax!)
CLS
DIM X(1000), Y(1000), RADIUS(1000), THETA(1000), RAD(361), THET(361), raycol(361)
PI = 3.1415926#
PRINT "Program:RBOUND"
PRINT "    "
PRINT "        A program to develop a derivative type curve multiplier"
PRINT "        for an arbitrary boundary.  The well location and the "
PRINT "        position of the boundary are read in from a data file"
PRINT "        (see SAMPLE.BND).  The program requests the duration of"
PRINT "        the well test and the radius of investigation at that time,"
PRINT "        and calculates the resulting boundary contact times and"
PRINT "        the Bourdet derivative effect that will be produced."
PRINT ""
PRINT " Copyright 1993, B. A. Slevinsky / Petro-Canada                    "
PRINT ""
PRINT " Produced specifically to illustrate the ray tracing interaction with"
PRINT " boundaries during well testing.                                    "
PRINT
"=================================================================
================"
INPUT "Enter the name of the location file                    "; ifile$
INPUT "Enter the test duration [hours]                        ", Ttest
INPUT "Enter the radius of Investigation                      ", Rinv
INPUT "Enter the Time Tolerance for the type curve evaluation [hours]  ", Tinc
INPUT "Enter the name of the file for output of type curve information "; ofile$
OPEN ifile$ FOR INPUT AS #1
INPUT #1, XWELL, YWELL
i = 0
WHILE NOT EOF(1)
   i = i + 1
   INPUT #1, X(i), Y(i)
WEND
CLOSE #1
NUMPTS = i
xmax = XWELL + Rinv / 2
xmin = XWELL - Rinv / 2
ymax = YWELL + Rinv / 2
ymin = YWELL - Rinv / 2


FOR i = 1 TO NUMPTS

   IF X(i) > xmax THEN xmax = X(i)
   IF X(i) < xmin THEN xmin = X(i)
   IF Y(i) > ymax THEN ymax = Y(i)
   IF Y(i) < ymin THEN ymin = Y(i)

   xdiff = ABS(XWELL - X(i))
   ydiff = ABS(YWELL - Y(i))
   RADIUS(i) = SQR(xdiff ^ 2 + ydiff ^ 2)
   IF X(i) >= XWELL THEN
      IF Y(i) > YWELL THEN
         quad = 1
```

The embodiments of the invention in which an exclusive property or privilege is claimed are defined as follows:

1. A method for creating an image of an oil, gas, or water reservoir boundary from well pressure test data values comprising:

(a) obtaining reservoir pressure response values from a well pressure test selected from the group consisting of drawdown, build-up, fall-off and pulse tests;

(b) using the pressure response values obtained to calculate data values reflecting the rate of pressure change over time and the radius of investigation;

(c) extracting from the data values obtained in step (b) the response that is due to near-wellbore and matrix effects, to obtain residual values representative of boundary effects;

(d) calculating values from the residual values representative of an angle-of-view of the boundary as a function of time;

(e) determining values, by analyzing and applying the angle-of-view values obtained in step (d) and the radius of investigation values, indicative of the location and orientation of the boundaries of the reservoir; and (f) forming visual images showing the reservoir boundaries relative to the location of the well, using the values determined in step (e).

2. The method as set forth in claim 1 comprising:

comparing the visual image obtained with an image of known reservoir features to substantially align the image to the reservoir.

3. The method as recited in claim 1 wherein steps (a) through (f) are repeated for each of multiple layers to assemble a three dimensional image of the reservoir.

4. The method as recited in claim 1 wherein steps (e) and (f) comprise:

calculating values, using each of several possible numerical models which use the angle-of-view values and the radius of investigation values, indicative of the location and orientation of the boundaries of the reservoir;

using the values calculated for each possible model to create visual images of the reservoir boundaries relative to the location of the well;

comparing the visual images obtained for each of the possible models with known reservoir features to select and substantially align the one selected image which best represents the reservoir.

5. The method as recited in claim 2, wherein steps (a) through (f) are repeated for each of multiple layers to assemble a three dimensional image of the reservoir.

6. The method of claim 1, wherein the determination of values indicative of the location and orientation of the boundaries of the reservoir, step (e), includes application of an assumed Angular Image Model, Balanced Image Model or Channel-Form Image Model for the boundaries and selection of the appropriate model by comparison to angle-of-view values, known geologic data and/or images from other proximally located wells.

* * * * *